US010809660B2

(12) United States Patent
Araishi

(10) Patent No.: US 10,809,660 B2
(45) Date of Patent: Oct. 20, 2020

(54) UNIT CASING AND IMAGE FORMING APPARATUS

(71) Applicant: KYOCERA Document Solutions Inc., Osaka (JP)

(72) Inventor: Kuniaki Araishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 86 days.

(21) Appl. No.: 16/301,515

(22) PCT Filed: Jun. 27, 2018

(86) PCT No.: PCT/JP2018/024369

§ 371 (c)(1),
(2) Date: Nov. 14, 2018

(87) PCT Pub. No.: WO2019/044143

PCT Pub. Date: Mar. 7, 2019

(65) Prior Publication Data

US 2020/0201240 A1 Jun. 25, 2020

(30) Foreign Application Priority Data

Aug. 31, 2017 (JP) ..... 2017-166326

(51) Int. Cl.
*G03G 21/16* (2006.01)
*B41J 29/02* (2006.01)

(52) U.S. Cl.
CPC ..... *G03G 21/1623* (2013.01); *B41J 29/02* (2013.01); *G03G 21/1619* (2013.01); *G03G 2221/1684* (2013.01)

(58) Field of Classification Search
CPC ..... G03G 21/1623; G03G 21/1619; G03G 2221/1684; B41J 29/02
See application file for complete search history.

(56) References Cited

U.S. PATENT DOCUMENTS

2008/0260443 A1* 10/2008 Noguchi ..... G03G 21/1623 399/381
2016/0274530 A1* 9/2016 Tanabe ..... G03G 21/1619

FOREIGN PATENT DOCUMENTS

| | | | |
|---|---|---|---|
| JP | H08-169164 | A | 7/1996 |
| JP | 2000-267500 | A | 9/2000 |
| JP | 2006-139226 | A | 6/2006 |
| JP | 2009-282402 | A | 12/2009 |

* cited by examiner

*Primary Examiner* — Sandra Brase
(74) *Attorney, Agent, or Firm* — Studebaker & Brackett PC

(57) ABSTRACT

A unit casing (1) is mounted in a casing (120) included in an image forming apparatus (100). The unit casing (1) includes a main body (2) and a positioning section (3). The positioning section (3) positions the main body (2) relative to the casing (120). The main body (2) includes a first frame segment (21) and a second frame segment (22) located opposite to the first frame segment (21). The positioning section (3) includes a positioning frame segment (31) extending in parallel to the first frame segment (21) and at least one penetrating member (32) extending from the positioning frame segment (31) and penetrating through the first and second frame segments (21) and (22). The at least one penetrating member (32) has a tip end held by the casing (120).

13 Claims, 4 Drawing Sheets

UNIT CASING AND IMAGE FORMING APPARATUS

TECHNICAL FIELD

The present invention relates to a unit casing and an image forming apparatus.

BACKGROUND ART

An image forming apparatus disclosed in Patent Literature 1 includes an image forming apparatus main body and a drawer unit. The drawer unit is insertable into and removable from the image forming apparatus main body. The drawer unit has a box shape. The drawer unit includes a front plate, a rear plate in parallel to the front plate, and a connection member. The connection member connects the front plate to the rear plate. Paired engaging holes are formed in the respective opposite ends of the front plate. A first pin is provided on the rear plate.

The image forming apparatus main body includes a main body front plate and a main body rear plate. Paired second pins are provided on the main body front plate. A hole is formed in the main body rear plate. In the image forming apparatus disclosed in Patent Literature 1, the first pin is engaged with the hole and the second pins are engaged with the engaging holes when the drawer unit is set in the image forming apparatus main body. As a result of the above setting, the drawer unit is positioned relative to the image forming apparatus main body.

CITATION LEST

Patent Literature

[Patent Literature 1]
Japanese Patent Application Laid-Open Publication No 2006-139226

SUMMARY OF INVENTION

Technical Problem

Note that frame segments (front plate and rear plate) of a unit casing (drawer unit) that are connected to each other by means of the connection member are positioned relative to a casing of the image forming apparatus disclosed in Patent Literature 1. In the above configuration, accumulation of dimensional tolerances between the frame segments may increase to invite lowering of positioning accuracy of the unit casing to the casing. It should be noted that low positioning accuracy of the unit casing in an image forming apparatus may invite for example sheet warping in sheet conveyance or toner localization to cause a defect in an image to be formed on the sheet.

The present invention has been made in view of the foregoing and has its object of providing a unit casing and an image forming apparatus in which accumulation of dimensional tolerances can be inhibited and positioning accuracy of the unit casing to a casing can be improved.

Solution to Problem

A unit casing according to the present invention is mounted in a casing included in an image forming apparatus. The unit casing includes a main body and a positioning section. The positioning section positions the main body relative to the casing. The main body includes a first frame segment and a second frame segment located opposite to the first frame segment. The positioning section includes a positioning frame segment and at least one penetrating member. The positioning frame segment extends in parallel to the first frame segment. The at least one penetrating member extends from the positioning frame segment and penetrates through the first and second frame segments. The at least one penetrating member has a tip end held by the casing.

An image forming apparatus according to the present invention includes the above unit casing and an image forming section. The image forming section forms an image.

Advantageous Effects of Invention

According to the unit casing and the image forming apparatus according to the present invention, accumulation of dimensional tolerances can be inhibited and positioning accuracy of the unit casing to the casing can be improved.

DESCRIPTION OF EMBODIMENTS

Figure 1:
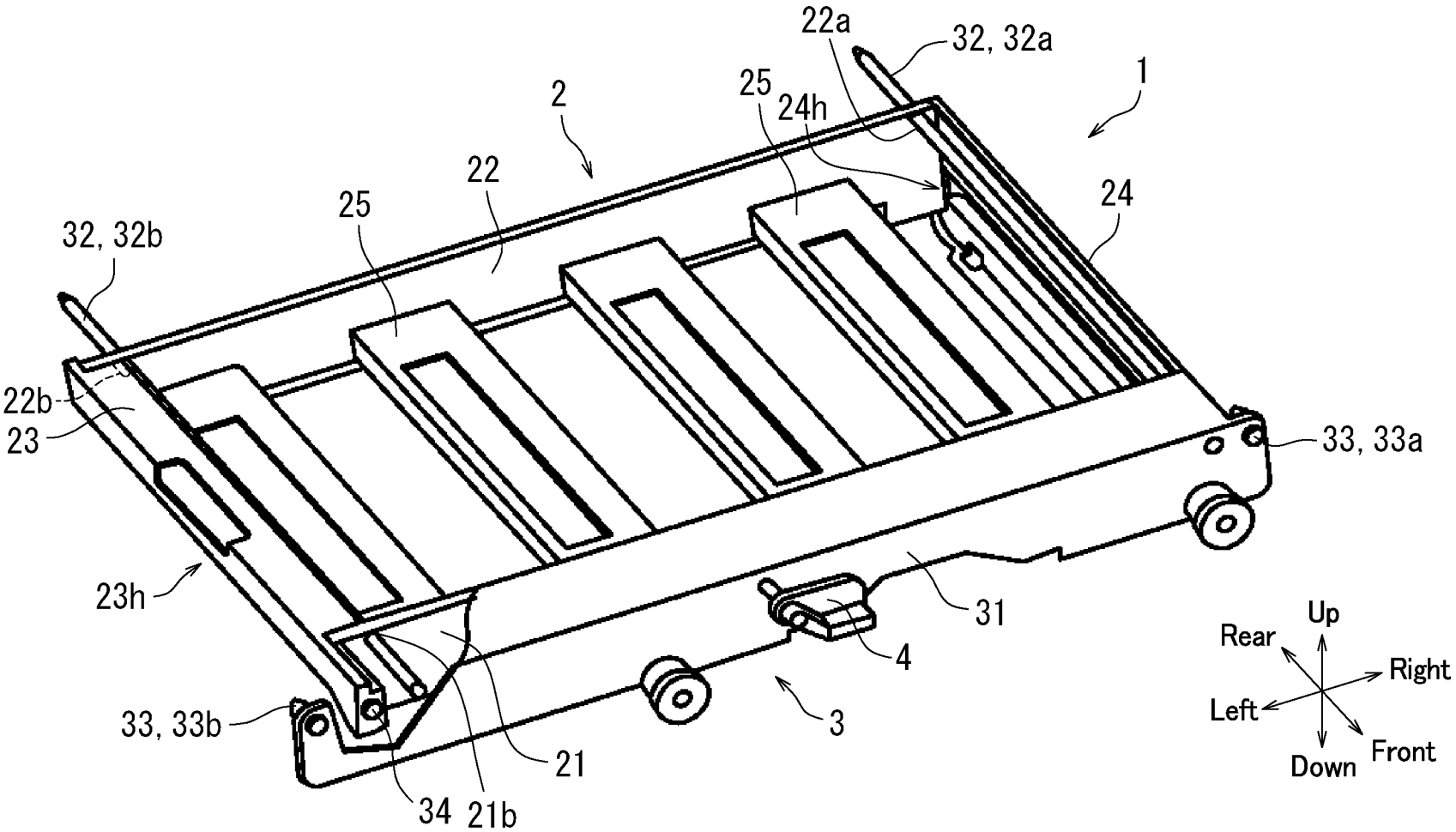
FIG. 1 is a perspective view illustrating a unit casing according to an embodiment of the present invention.

An embodiment of the present invention will be described below with reference to the drawings. However, the present invention is not limited to the following embodiment. It should be noted that elements in the drawings that are the same or equivalent are labelled using the same reference signs and description thereof is not repeated.

Figure 2:
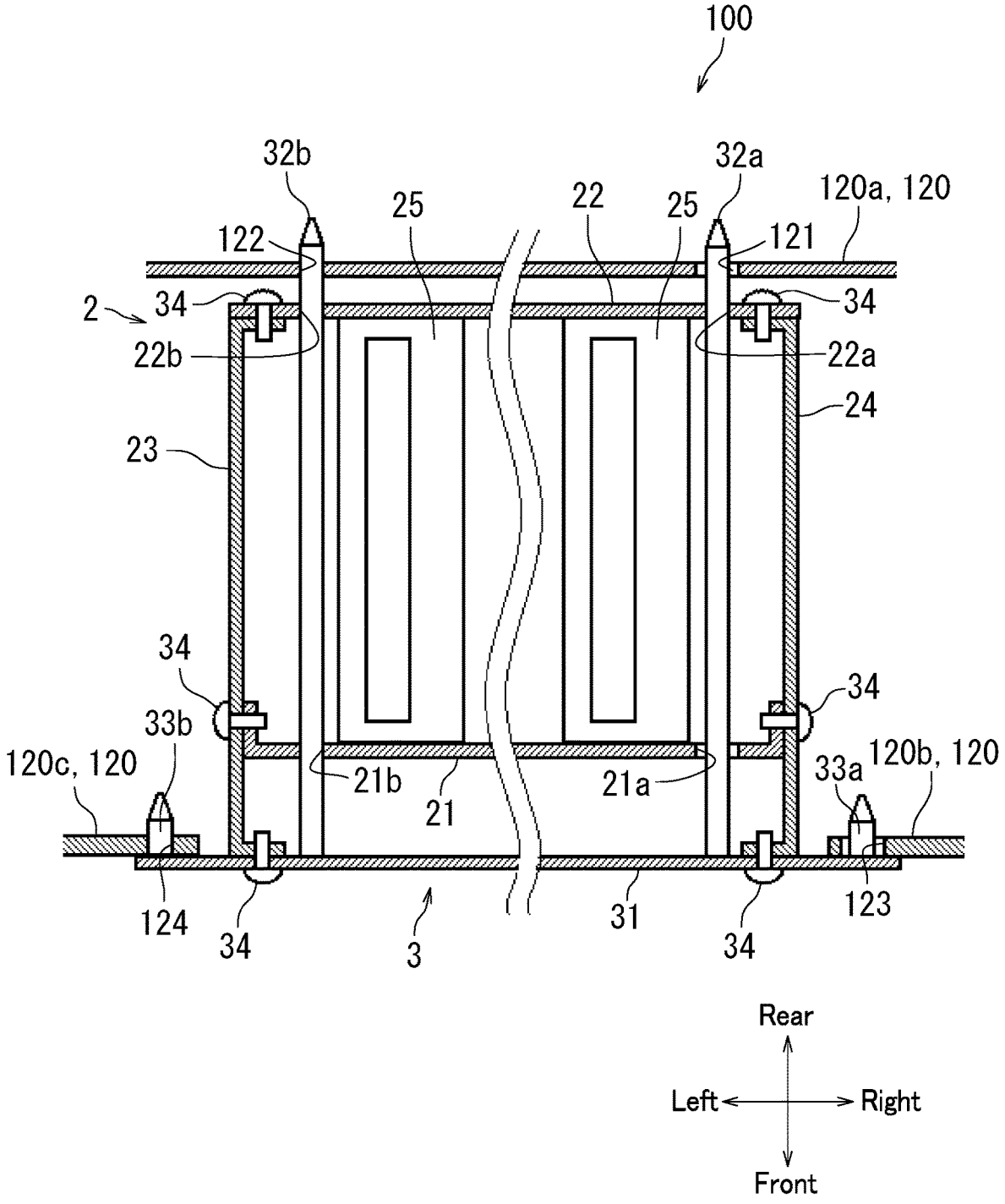
FIG. 2 is a cross-sectional view illustrating a configuration of the unit casing according to the embodiment of the present invention.

The following describes a unit casing 1 according to the embodiment of the present invention with reference to FIGS. 1 and 2. FIG. 1 is a perspective view illustrating the unit casing I according to the present embodiment. FIG. 2 is a cross-sectional view illustrating a configuration of the unit casing I according to the present embodiment.

As illustrated in FIGS. 1 and 2, the unit casing 1 according to the present embodiment constitutes a part of a conveyance section that conveys a sheet. Specifically, an image forming apparatus 100 includes a casing 120 (see FIG. 2). The unit casing 1 is mounted in the casing 120 of the image forming apparatus 100 to constitute a part of a sheet conveyance path. The unit casing 1 includes a main body 2 and a positioning section 3.

The main body 2 has a box shape. The main body 2 includes a first frame segment 21, a second frame segment 22, a third frame segment 23, a fourth frame segment 24, and a plurality of fifth frame segments 25. The first frame segment 21, the second frame segment 22, the third frame segment 23, and the fourth frame segment 24 each constitute a wall of the main body 2. In the embodiment described below, it is assumed that a site where the first frame segment 21 is located is the front of the unit casing 1 and the opposite site thereof is the rear of the unit casing 1. It is also assumed that a site where the third frame segment 23 is located is the left of the unit casing 1 and the opposite site thereof is the right of the unit casing 1. In the embodiment described below, it is further assumed that a direction perpendicular to a front-back direction and a left-right direction is an up-and-down direction. Note that a left part of the positioning section 3 is cut away in FIG. 1 in order to facilitate easy understanding.

The first and second frame segments 21 and 22 each have a plate shape. The second frame segment 22 is located opposite to the first frame segment 21. The second frame segment 22 is disposed in parallel to the first frame segment 21. An engaging hole 21*a* is formed in one of ends (right end) of the first frame segment 21 (see FIG. 2), while another engaging hole 21*b* is formed in the other end (left end) thereof An engaging hole 22*a* is formed in one of ends (right end) of the second frame segment 22, while another engaging hole 22*b* is formed in the other end (left end) of the second frame segment 22.

The third frame segment 23 extends perpendicularly to the first and second frame segments 21 and 22. The third frame segment 23 connects the other end of the first frame segment 21 to the other end of the second frame segment 22. Specifically, the third frame segment 23 connects an upper end of the other end of the first frame segment 21 to an upper end of the other end of the second frame segment 22. In the above configuration, a first opening 23*h* through which the interior and the exterior of the main body 2 communicate with each other is formed below the third frame segment 23. The first opening 23*h* is large enough for a sheet having a specific size to pass therethrough.

The fourth frame segment 24 extends perpendicularly to the first and second frame segments 21 and 22. The fourth frame segment 24 is located opposite to the third frame segment 23. The fourth frame segment 24 connects the one end of the first frame segment 21 to the one end of the second frame segment 22. Furthermore, a second opening 24*h* is formed in the fourth frame segment 24. The second opening 24*h* is located in a central part of the fourth frame segment 24 in the up-and-down direction, and extends from the first frame segment 21 to the second frame segment 22. The second opening 24*h* is large enough for the sheet having the specific size to pass therethrough.

Each of the fifth frame segments 25 has a plate shape. The fifth frame segments 25 extend perpendicularly to the first and second frame segments 21 and 22. The fifth frame segments 25 are supported by the first and second frame segments 21 and 22. The fifth frame segments 25 each constitute a bottom portion of the main both 2. The fifth frame segments 25 are disposed between the third and fourth frame segments 23 and 24. The fifth frame segments 25 are disposed at specific intervals in a direction in which the first frame segment 21 extends.

The positioning section 3 includes a positioning frame segment 31, paired penetrating members 32, and paired engaging portions 33. Here, each of the penetrating members 32 is an example of "at least one penetrating member" in the present invention. Also, each of the engaging portions 33 is an example of "at least one engaging portion" in the present invention.

The positioning frame segment 31 extends in parallel to the first frame segment 21. The positioning frame segment 31 has an L-shape in cross section when cut in a direction (front-back direction) perpendicular to a direction in which the positioning frame segment 31 extends. The positioning frame segment 31 is fixed at a site of the first frame segment 21 of the main body 2. Specifically, the positioning frame segment 31 is fixed to third frame 23 and the fourth frame 24 by means of fixing pins 34.

Each of the penetrating members 32 has a long rod shape. Each of the penetrating members 32 has a circular shape in cross section. Each of the penetrating members 32 penetrates through the first and second frame segments 21 and 22. Each of the penetrating members 32 has one (rear) end (also referred to below as a tip end) that is held by the casing 120 of the image forming apparatus 100 (see FIG. 2). The paired penetrating members 32 include a first penetrating member 32*a* located close to the fourth frame segment 24 and a second penetrating member 32*b* located close to the third frame segment 23.

The first penetrating member 32*a* has a base end fixed to the positioning frame segment 31. Furthermore, the first penetrating member 32*a* engages with the right engaging hole 21*a* of the first frame segment 21 and the right engaging hole 22*a* of the second frame segment 22, and penetrates through the first and second frame segments 21 and 22. The right engaging hole 21*a* of the first frame segment 21 is a slot extending in a horizontal direction (left-right direction, see FIG When the first penetrating member 32*a* penetrates through the right engaging hole 21*a* of the first frame segment 21, an upper part and a lower part of an outer circumferential surface of the first penetrating member 32*a* come into contact with an inner circumferential surface of the engaging hole 21*a*. By contrast, the right engaging hole 22*a* of the second frame segment 22 is a round hole. The right engaging hole 22*a* of the second frame segment 22 has a shape corresponding to the shape of the first penetrating member 32*a*. When the first penetrating member 32*a* penetrates through the right engaging hole 22*a* of the second frame segment 22, the outer circumferential surface of the first penetrating member 32*a* comes into contact with an inner circumferential surface of the engaging hole 22*a*. When the unit casing 1 is mounted in the casing 120 of the image forming apparatus 100, the tip end of the first penetrating member 32*a* is held by the casing 120 of the image forming apparatus 100 (see FIG. 2).

The second penetrating member 32*b* has a base end fixed to the positioning frame segment 31. Furthermore, the second penetrating member 32*b* engages with the left engaging hole 21*b* of the first frame segment 21 and the left engaging hole 22*b* of the second frame segment 22, and penetrates through the first and second frame segments 21 and 22. The left engaging hole 21*b* of the first frame segment 21 and the left engaging hole 22*b* of the second frame segment 22 each are a round hole. The left engaging hole 21*b* of the first frame segment 21 and the left engaging hole 22*b* of the second frame segment 22 each have a shape corresponding to the shape of the second penetrating member 32*b*. When the second penetrating member 32*b* penetrates through the left engaging hole 21*b* of the first frame segment 21, an outer circumferential surface of the second penetrating member 32*b* comes into contact with an inner circumferential surface of the left engaging hole 21*b* of the first frame segment 21. Also, when the second penetrating member 32*b* penetrates through the left engaging hole 22*b* of the second frame segment 22, the outer circumferential surface of the second penetrating member 32*b* comes into contact with an inner circumferential surface of the left engaging hole 22*b* of the second frame segment 22. When the unit casing 1 is mounted in the casing 120 of the image forming apparatus 100, the tip end of the second penetrating member 32*b* is held by the casing 120 of the image forming apparatus 100.

The paired engaging portions 33 are fixed to the positioning frame segment 31. Each of the engaging portions 33 is engageable with the casing 120 of the image forming apparatus 100 when the unit casing 1 is mounted in the casing 120 of the image forming apparatus 100. In the present embodiment, each engaging portion 33 has a circular shape in cross section, and is for example a pin. The paired engaging portions 33 include a first engaging portion 33*a* located close to the fourth frame segment 24 and a second engaging portion 33*b* located close to the third frame segment 23. The first engaging portion 33*a* is fixed at a part of the positioning frame segment 31 located outside the first penetrating member 32*a* in a longitudinal direction of the positioning frame segment 31. The second engaging portion 33*b* is fixed at a part of the positioning frame segment 31 located outside the second penetrating member 32*b* in the longitudinal direction of the positioning frame segment 31.

In order to assemble the unit casing 1, an operator inserts the paired penetrating members 32 fixed to the positioning frame segment 31 through the first and second frame segments 21 and 22. Specifically, the operator inserts (passes) the first and second penetrating members 32*a* and 32*b* through the first and second frame segments 21 and 22. The operator then fixes the third and fourth frame segments 23 and 24. Specifically, as illustrated in FIG. 2, the third and fourth frame segments 23 and 24 are fixed to the positioning frame segment 31 by means of the fixing pins 34, and fixed to the first and second frame segments 21 and 22 by means of other fixing pins 34. In the present embodiment, each of the penetrating members 32 fixed to the positioning frame segment 31 penetrates through the first and second frame segments 21 and 22 and held by the casing 120 of the image forming apparatus 100. Furthermore, each of the penetrating members 32 engages with the first and second frame segments 21 and The above configuration can accordingly facilitate operation to position respective members. Specifically, the operator need not position the respective members for example using a jig in assembling the unit casing 1. Thus, operation to assemble the unit casing 1 can be facilitated.

When the unit casing 1 according to the present embodiment is mounted in the casing 120 of the image forming apparatus 100, the tip ends of the paired penetrating members 32 are held by the casing 120 of the image forming apparatus 100. The paired engaging portions 33 are also engaged with the casing 120 of the image forming apparatus 100. Each of the penetrating members 32 and the engaging portions 33 is fixed to the positioning frame segment 31. In the above configuration, accumulation of dimensional tolerances can be inhibited when compared with a configuration in which the first and second frame segments 21 and 22 are to be positioned relative to the casing 120 of the image forming apparatus 100. Eventually, positioning accuracy of the unit casing 1 to the casing 120 of the image forming apparatus 100 can be improved. Also, sheet warping can for example be inhibited in sheet conveyance.

Figure 3:
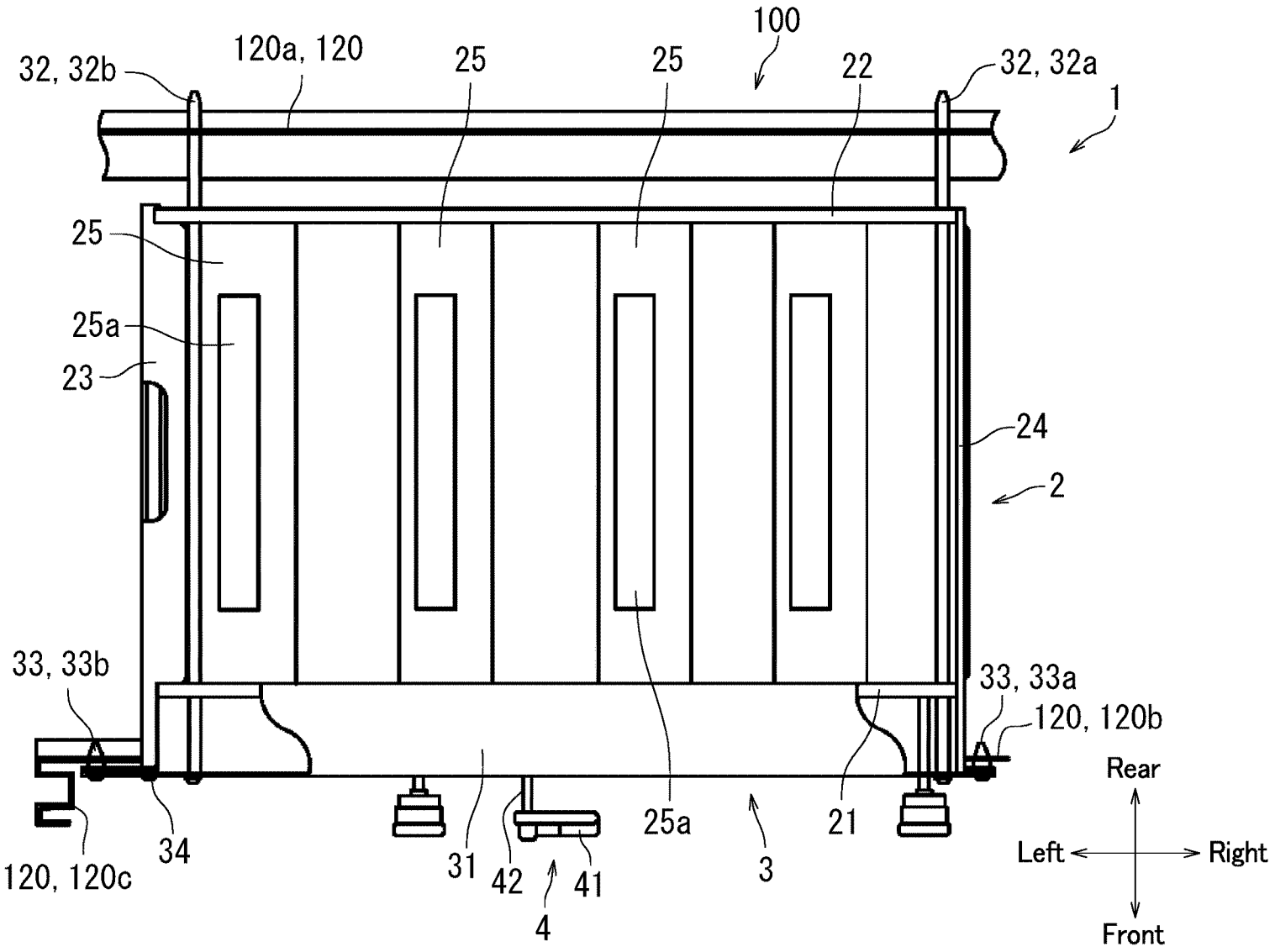
FIG. 3 is a plan view illustrating the unit casing according to the embodiment of the present invention.

The following further describes a configuration of the unit casing 1 with reference to FIGS. 2 and 3. FIG. 3 is a plan view illustrating the unit casing 1 according to the present embodiment.

The casing 120 includes a first casing frame segment 120*a*, a second casing frame segment 120*b*, and a third casing frame segment 120*c*. The first casing frame segment 120*a* constitutes for example a part of a wall of the casing 120 in the rear of the casing 120. The second casing frame segment 120*b* constitutes for example a part (right part) of the wall of the casing 120 in a width direction of the casing 120 in the front of the casing 120. The third casing frame segment 120*c* constitutes for example another part (left part) of the wall of the casing 120 in the width direction thereof in the front of the casing 120.

As illustrated in FIG. 2, the first casing frame segment 120*a* has a first positioning hole 121 and a second positioning hole 122. Specifically, the first positioning hole 121 is located opposite to the engaging hole 22*a*. The second positioning hole 122 is located opposite to the engaging hole 22*b*.

The first positioning hole 121 holds the tip end of the first penetrating member 32*a*. The first positioning hole 121 is a slot extending in the horizontal direction (left-right direction). When the first penetrating member 32*a* penetrates through the first positioning hole 121, an upper part and a lower part of the outer circumferential surface of the first penetrating member 32*a* come into contact with an inner circumferential surface of the first positioning hole 121.

The second positioning hole 122 holds the tip end of the second penetrating member 32*b*. The second positioning hole 122 is a round hole. The second positioning hole 122 has a shape corresponding to the shape of the second penetrating member 32*b*. When the second penetrating member 32*b* penetrates through the second positioning hole 122, the outer circumferential surface of the second penetrating member 32*b* comes into contact with an inner circumferential surface of the second positioning hole 122.

The second casing frame segment 120*b* has a third positioning hole 123. The third positioning hole 123 engages with the first engaging portion 33*a*. The third positioning hole 123 is a slot extending in the horizontal direction (left-right direction). When the first engaging portion 33*a* penetrates through the third positioning hole 123, an upper part and a lower part of an outer circumferential surface of the first engaging portion 33*a* come into contact with an inner circumferential surface of the third positioning hole 123.

The third casing frame segment 120*c* has a fourth positioning hole 124. The fourth positioning hole 124 engages with the second engaging portion 33*b*. The fourth positioning hole 124 is a round hole. The fourth positioning hole 124 has a shape corresponding to the shape of the second engaging portion 33*b*. When the second engaging portion 33*b* penetrates through the fourth positioning hole 124, an outer circumferential surface of the second engaging portion 33*b* comes into contact with an inner circumferential surface of the fourth positioning hole 124.

As illustrated in FIG. 3, each of the fifth frame segments 25 of the unit casing 1 has a third opening 25*a*, The third opening 25*a* is located at a central part of the fifth frame segment 25.

The unit casing 1 further includes an operation section 4. In mounting the unit casing 1 into the casing 120, the operation section 4 fixes the unit casing 1 to the casing 120. For example, after the unit casing 1 is set in the casing 120, the operation section 4 is operated by the operator. The operation section 4 includes for example a lever 41, a shaft 42, and a turning pin. A part of the operation section 4 is located between the first frame segment 21 and the positioning frame segment 31.

The shaft 42 of the operation section 4 is pivotally supported for example by the first frame segment 21 and the positioning frame segment 31. The lever 41 of the operation section 4 is fixed to one (front) end of the shaft 42. In the above configuration, the shaft 42 rotates in association with operation on the lever 41. The turning pin is fixed to the shaft 42. The turning pin is located for example between the first frame segment 21 and the positioning frame segment 31. The tuning pin is projected for example from the bottom of the main body 2 in association with operation on the lever 41 to be engaged with the casing 120.

The following specifically describes operation to mount the unit casing 1 into the casing 120 of the image forming apparatus 100. The unit casing 1 according to the present embodiment is set within the casing 120 for example such that the first frame segment 21 is located close to the front (front side) of the casing 120 and the second frame segment 22 is located close to the rear (rear side) of the casing 120. The unit casing 1 is inserted into the interior of the casing 120 from the front toward the rear of the casing 120 between the second and third casing frame segments 120*b* and 120*c* for example along a guide rail provided on the casing 120. When the unit casing 1 is inserted into the interior of the casing 120, the respective tip ends of the paired penetrating members 32 are held in the first and second positioning holes 121 and 122 formed in the first casing frame segment 120*a* (see FIG. 2), Furthermore, the first engaging portion 33*a* is engaged with the third positioning hole 123 formed in the second casing frame segment 120*b* and the second engaging portion 33*b* is engaged with the fourth positioning hole 124 formed in the third casing frame segment 120*c* (see FIG. 2). Through the above, the unit casing 1 is positioned relative to the casing 120.

After the unit casing 1 is positioned relative to the casing 120, the operation section 4 is operated. Specifically, the turning pin is projected from the bottom of the main body 2 to be engaged with the casing 120 in association with operation on the operation section 4. Through the above engagement, movement of the unit casing 1 along the guide rail is restricted and the unit casing 1 is mounted in the casing 120.

The following describes movement of a sheet passing through the main body 2 of the unit casing 1. A roller that rotates in sheet conveyance is disposed for example under the third opening 25*a* of each of the fifth frame segments 25. A portion of the roller is exposed through the third opening 25*a*. Furthermore, a plate member forming the sheet conveyance path is disposed on each of the fifth frame segments 25. The upper level of the plate member is almost equal to a bottom level of the second opening 24*h* formed in the fourth frame segment 24.

The sheet passes through the main body 2 of the unit casing 1 according to the present embodiment. Specifically, the sheet is fed between the first and second frame segments 21 and 22 through the first opening 23*h* of the third frame segment 23. The fed sheet is conveyed along the plate members by the rollers and ejected out of the main body 2 through the second opening 24*h* of the fourth frame segment 24.

Figure 4:
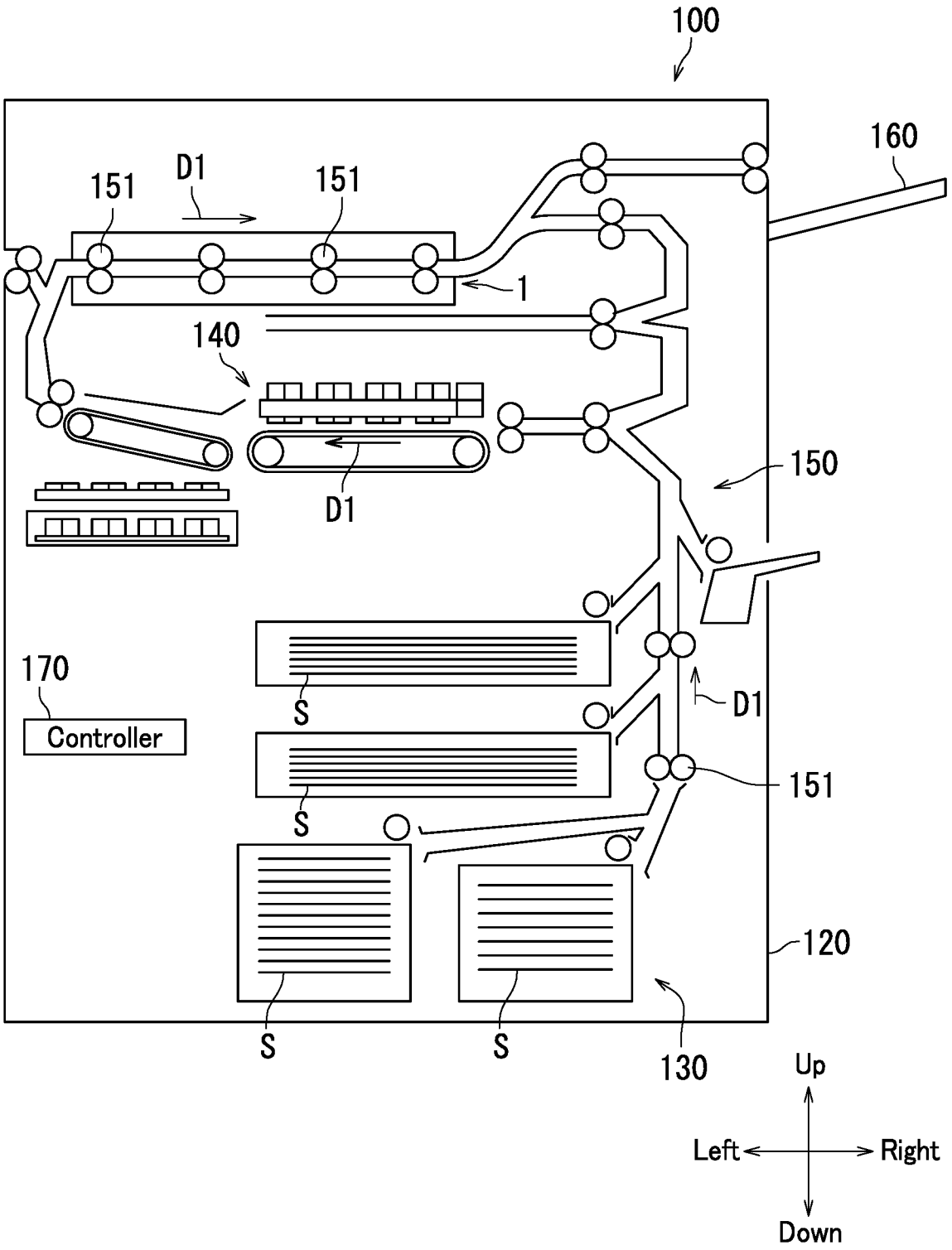
FIG. 4 is a diagram illustrating an image forming apparatus according to the embodiment of the present invention.

The following describes further the image forming apparatus 100 according to the present embodiment with reference to FIG. 4. FIG. 4 is a diagram illustrating a configuration of the image forming apparatus 100.

As illustrated in FIG. 4, the image forming apparatus 100 forms an image on a sheet S. The image forming apparatus 100 is a multifunction peripheral in the present embodiment. The multifunction peripheral has for example at least two functions among a copy function, a printing function, and a faxing function.

The sheet S is for example a sheet of plain paper, copy paper, recycled paper, thin paper, thick paper, or glossy paper, or an overhead projector (OHP) sheet.

The image forming apparatus 100 includes a sheet feed section 130, an image forming section 140, a conveyance section 150, an exit tray 160, a controller 170, and the unit casing 1 in addition to the casing 120. The casing 120 accommodates in the interior thereof the sheet feed section 130, the image forming section 140, the conveyance section 150, the controller 170, and the unit casing 1.

The sheet feed section 130 feeds at least one sheet S. Specifically, the sheet feed section 130 includes a plurality of sheet feed cassettes. Each of the sheet feed cassettes accommodates a plurality of sheets S. The sheet feed cassette feeds a sheet S toward the conveyance section 150.

The conveyance section 150 conveys the sheet S in a conveyance direction D1. The conveyance section 150 includes a plurality of rollers 151. The unit casing 1 is mounted in the casing 120 to constitute a part of the conveyance section 150. The unit casing 1 conveys the sheet S in the conveyance direction D1.

The image forming section 140 forms an image on the sheet S conveyed in the conveyance direction D1. The image forming section 140 includes a plurality of recording heads corresponding to respective inks in different colors. The sheet S with the image formed thereon is ejected onto the exit tray 160.

The controller 170 controls respective elements of the image forming apparatus 100. The controller 170 includes for example a processor and storage. The processor is for example a central processing unit (CPU). The storage includes for example semiconductor memory and a hard disk drive (HDD). The processor controls the sheet feed section 130, the image forming section 140, and the conveyance section 150 based on computer programs. The computer programs are stored in the storage in advance.

The unit casing 1 and the image forming apparatus 100 according to an embodiment of the present invention have been described so far with reference to FIGS. 1 to 4. However, the present invention is not limited to the above-described embodiment and can be practiced in various ways within the scope not departing from the gist of the present invention.

For example, the penetrating members 32 include the first and second penetrating members 32*a* and 32*b* in the embodiment of the present invention, which however should not be taken to limit the present invention. It is only required that at least one penetrating member 32 extend from the positioning frame segment 31 and penetrate through the first and second frame segments 21 and 22 and the tip end thereof be held by the casing 120. Only one of the first and second penetrating members 32*a* and 32*b* can suffice among the penetrating members 32.

In other words, the at least one penetrating member 32 may for example be a third penetrating member in place of the first and second penetrating members 32*a* and 32*b*. The third penetrating member extends from the central part of the positioning frame segment 31 and penetrates through the first and second frame segments 21 and 22, and a tip end of the third penetrating member is held by the casing 120. Alternatively, the penetrating members may for example include the third penetrating member in addition to the first and second penetrating members 32*a* and 32*b*.

The engaging portions 33 include the first engaging portion 33*a* and the second engaging portion 33*b* in the embodiment of the present invention, which however should not be taken to limit the present invention. It is only required that at least one engaging portion 33 is engaged with the casing 120 when the unit casing 1 is mounted in the casing 120. Only one of the first and second engaging portions 33*a* and 33*b* can suffice among the engaging portions 33.

Furthermore, the unit casing 1 constitutes a part of the conveyance section 150 of the image forming apparatus 100 in the embodiment of the present invention, which however should not be taken to limit the present invention. It is only required that the unit casing 1 be positioned by the positioning section 3 when mounted in the casing 120 of the image forming apparatus 100. The unit casing 1 may accommodate in the interior thereof the image forming section 140 rather than the fifth frame segments 25, for example.

Note that the drawings are intended to illustrate mainly elements of configuration in a schematic manner to assist with understanding. The thickness, the length, and so on of each element of configuration illustrated are not true to scale for diagrammatic purposes. The shape and so on of each element of configuration shown in the above-described embodiment are exemplary only and not particularly limited. Various alternations can be made thereto within the scope not substantially departing from the advantageous effects of the present invention.

INDUSTRIAL APPLICABILITY

The present invention relates to a unit casing, and is useful for inhibition of accumulation of dimensional tolerances and improvement in positioning accuracy of the unit casing to a casing.

The invention claimed is:

1. A unit casing mounted in a casing included in an image forming apparatus, the unit casing comprising:
- a main body; and
- a positioning section that positions the main body relative to the casing, wherein
- the main body includes a first frame segment, a second frame segment located opposite to the first frame segment, and a third frame segment that connects the first frame segment to the second frame segment,
- the positioning section includes:
  - a positioning frame segment extending in parallel to the first frame segment; and
  - at least one penetrating member extending from the positioning frame segment and penetrating through the first and second frame segments,
- the positioning frame segment is fixed to the third frame segment, and
- the at least one penetrating member has a tip end held by the casing.

2. The unit casing according to claim 1, wherein
- the positioning section further includes an engaging portion extending from an end of the positioning frame segment, and
- the engaging portion engages with the casing.

3. The unit casing according to claim 2, wherein
- the at least one penetrating member is disposed inside the engaging portion in a direction in which the positioning frame segment extends.

4. An image forming apparatus comprising:
- the unit casing according to claim 2; and
- an image forming section configured to form an image.

5. The unit casing according to claim 1, wherein
- the positioning frame segment is fixed to the main body.

6. An image forming apparatus comprising:
- the unit casing according to claim 5; and
- an image forming section configured to form an image.

7. The unit casing according to claim 1, wherein
- the third frame segment has a first opening through which a sheet having a specific size passes.

8. The unit casing according to claim 7, wherein
- the main body includes a fourth frame segment located opposite to the third frame segment, and
- the fourth frame segment has a second opening through which the sheet having the specific size passes.

9. The unit casing according to claim 8, wherein
- the main body includes a plurality of fifth frame segments disposed between the third and fourth frame segments,
- the fifth frame segments are disposed at specific intervals in a direction in which the first frame segment extends, and
- each of the fifth frame segments has a third opening.

10. An image forming apparatus comprising:
- the unit casing according to claim 7; and
- an image forming section configured to form an image.

11. The unit casing according to claim 1, wherein
- the at least one penetrating member is provided as two penetrating members,
- the first frame segment has two holes through which the respective two penetrating members penetrate,
- one of the two holes has a shape corresponding to a shape of a corresponding one of the two penetrating members, and
- the other of the two holes is a slot extending in a direction in which the first frame segment extends.

12. An image forming apparatus comprising:
- the unit casing according to claim 11; and
- an image forming section configured to form an image.

13. An image forming apparatus comprising:
- the unit casing according to claim 1; and
- an image forming section configured to form an image.

* * * * *